US007966792B1

(12) United States Patent
Hills

(10) Patent No.: US 7,966,792 B1
(45) Date of Patent: Jun. 28, 2011

(54) DEVICE FOR ENCASING LIGHT STRINGS FOR STORAGE

(76) Inventor: Gary B. Hills, Auburn, WA (US)

( * ) Notice: Subject to any disclaimer, the term of this patent is extended or adjusted under 35 U.S.C. 154(b) by 229 days.

(21) Appl. No.: 12/429,152

(22) Filed: Apr. 23, 2009

(51) Int. Cl.
*B65B 9/06* (2006.01)

(52) U.S. Cl. ..... 53/567; 53/413; 53/459; 53/576

(58) Field of Classification Search ..... 53/567, 53/568, 576, 585, 413, 459; 206/419, 420; 220/890
See application file for complete search history.

(56) References Cited

U.S. PATENT DOCUMENTS

| | | | | |
|---|---|---|---|---|
| 2,741,884 | A * | 4/1956 | Best | 53/585 |
| 2,847,805 | A * | 8/1958 | Robbins | 53/428 |
| 3,542,021 | A * | 11/1970 | Preston | 602/1 |
| 4,104,774 | A * | 8/1978 | Overmyer et al. | 29/234 |
| 4,292,711 | A * | 10/1981 | Becker | 452/33 |
| 4,809,484 | A * | 3/1989 | Lovik | 53/434 |
| 4,993,210 | A * | 2/1991 | Kollross | 53/428 |
| 5,293,501 | A | 3/1994 | Bennett et al. | |
| 5,419,030 | A * | 5/1995 | Szymberski | 29/450 |
| 5,581,984 | A * | 12/1996 | Domke et al. | 53/552 |
| 5,899,049 | A * | 5/1999 | Fuss et al. | 53/459 |
| 6,009,688 | A | 1/2000 | Pedersen et al. | |
| 7,204,367 | B2 * | 4/2007 | Bott et al. | 206/219 |
| 2005/0032470 | A1 * | 2/2005 | Lopez | 452/35 |
| 2005/0281924 | A1 * | 12/2005 | Arias Lopez | 426/129 |
| 2007/0205209 | A1 | 9/2007 | Arnold et al. | |

* cited by examiner

*Primary Examiner* — Thanh K Truong
(74) *Attorney, Agent, or Firm* — Joseph Z. Ellsworth

(57) ABSTRACT

This device for encasing light strings for storage provides a canister as a handle that is concentric with a cylindrical feed tube that is at least partially within the canister together with a cartridge type removable dispensing tube that slides over the feed tube and within the canister. The canister is attached to the large end of a funnel on the feed tube entry end through which a light string may be fed. The canister and feed tube thus form an annular slot into which the removable cartridge type dispensing tube may be received and releasably secured slidably over the feed tube. The tubular plastic is loaded on the dispensing tube prior to the dispensing tube being slid and secured over the feed tube.

15 Claims, 3 Drawing Sheets

DEVICE FOR ENCASING LIGHT STRINGS FOR STORAGE

BACKGROUND

1. Field of the Invention

This invention relates to devices for encasing elongated objects, and more specifically to encasing light strings for ease of storage and safe keeping.

2. Prior Art

Commonly, holiday light strings are typically inconvenient to store and are prone to tangling and breakage. As a result time is required to untangle the strings prior to re-use and often light strings are often not re-used and new ones are purchased instead of investing the time to sort out the previously used strings. Icicle style lights exacerbate the problem. The problem calls for a device that preserves light strings in storage without entangling them with a minimal time investment of perhaps only several seconds and offers a quick recovery of the lights from storage for re-use.

It is well known to have devices on which light strings may be wrapped or hanged. However, even a carefully wrapped set of lights has a tendency to tangle and break. There are some prior patents that describe encasing a light string or other elongated article that might have dangling components in a sheath that collapses around the article.

Pederson in U.S. Pat. No. 6,009,688 discloses cylinder within a box and a plastic tubing compressed on the cylinder with cylinder entry and exit ends opening at opposite sides of the box. Access to the cylinder is obtained by opening the box. Though apparently functional, the device is not handheld and restricts access to the plastic dispensing cylinder which slows replacement of the cylinder when plastic is exhausted from the cylinder during use.

Arnold et al. in U.S. Pat. Application No. 2007/0205209 discloses a compressed plastic over a cylindrical tube with a funnel into which a string of lights may be fed for encasing the lights within the plastic for storage. The device provides improved access but does not provide a handle and therefore a user must grasp the device over the plastic and the plastic is fully exposed and unprotected. It also requires reloading of plastic over the tube for each use.

Bennett et al. in U.S. Pat. No. 5,293,501 discloses cylinder over which a stretchable material is mounted. A wiring harness is fed through the cylinder and as it exits the cylinder the stretchable material is peeled off the cylinder and onto the wiring harness. The device also does not provide a protective handle for handheld use. The device also requires reloading of the material over the cylinder for each application over a wiring harness.

The object of the present invention then is to provide a feed tube adapted to receive a string of lights or generally an elongated object through a funnel at a feed tube entry end. It is a another object to provide a cartridge styled dispensing tube that removably mounts slidably on the feed tube from the feed tube exit end. It is a further object that the dispensing tube be adapted to receive a non-rigid material, typically a tubular plastic, compressed over the dispensing tube. It is a still further object that access to the feed tube exit end is open and unrestricted such that unimpaired access facilitates quick and easy installation and replacement of a dispensing tube. It is yet another object to provide a handle that protects the dispensing tube and the non-rigid material thereon. It is a yet further object that the handle supports the feed and dispensing tubes without contacting and thereby interfering with the non-rigid material on the dispensing tube. It is still another a object that a user have unrestricted access to the dispensing tube during dispensing of the non-rigid material. It is final object that the device be handheld so it can be conveniently used immediately at a holiday tree as light strings are removed from the tree.

SUMMARY

The above objects are achieved in a canister as a handle that is concentric with a cylindrical feed tube that is at least partially within the canister and a cartridge type removable dispensing tube that slides over the feed tube and within the canister. The canister is attached to the large end of a funnel on the feed tube entry end through which a light string may be fed. The canister and feed tube thus form an annular slot into which the removable cartridge type dispensing tube may be received and releasably secured slidably over the feed tube. A tubular plastic or other non-rigid material loaded on the dispensing tube is then at least partially protected within the annular slot and a user grasping the canister as a handle does not contact the plastic and thus does not interfere with the plastic as it is being peeled off the dispensing tube and onto the light string as the light string exits the feed tube. The tubular plastic is loaded on the removable dispensing tube prior to the dispensing tube being slid and secured over the feed tube. Thus a plurality of mounting tubes may be loaded in preparation for encasing a several light strings to obviate the need to reload a cartridge with plastic between each application over a light string. A user simply dispenses plastic from a dispensing tube over a light string, removes the dispensing tube from the feed tube and mounts a next dispensing tube preloaded with plastic over the feed tube thus expediting the encasing of light strings within tubular plastic for storing. At a later time, the light string may be pulled from within the plastic tubing without destroying the plastic tubing The plastic tubing is then retained for later re-application over a light string.

The dispensing tube may mount fully over the feed tube, in which case the feed tube typically extends beyond the canister handle for convenience in mounting and removing the dispensing tube from within the canister handle. Similarly, the feed tube may be fully within the canister handle in which case the dispensing tube only partially mounts over the feed tube and extends beyond the canister handle when it is mounted on the feed tube, again for convenient mounting and removal of the dispensing tube from over the feed tube.

A catch member may be provided on this dispensing tube flange to releasably engage a matching catch member on the feed tube, or an extension of the feed tube, or equivalently on the funnel or the inside of the canister handle. Or similarly the catch may comprise a first catch member on the outer circumference of the feed tube with a matching catch member on the inner surface of the dispensing tube in which case the feed tube and dispensing tube directly engage. It is recognized that the nature of the catch may be of many designs and locations. A catch with matching catch members are described herein. However, as many catch types, designs and locations may be employed with equivalent result—to releasably secure the removable dispensing tube from the annular slot and from over the feed tube, it should be understood that the described catch is presented only as representative of the many catches that may be employed, all of which are deemed included in this invention.

Peripheral components are provided to facilitate convenient use of the device. A dispensing tube flange is mounted to the non-dispensing end of the dispensing tube. It is this end that is received first into the annular slot. The dispensing tube flange extending radially beyond the circumference of the dispensing tube and typically on the dispensing tube non-dispensing end functions to retain the plastic from falling over the non-dispensing end as the plastic is compressed over the dispensing tube to enable an extended tubular plastic to fit over a dispensing tube of shorter length. As the dispensing tube is typically pre-loaded with plastic tubing prior to being mounted on the feed tube, a flange cap is provided that fits into the dispensing end of the dispensing tube to prevent compressed plastic from falling off that end.

A load cone is also provided with its larger end that also mounts into the dispensing tube dispensing end and its smaller end extending longitudinally from the dispensing tube to facilitate loading of the tubular plastic onto the dispensing tube, tubular plastic being fed over the small end of the cone and guided by the load cone onto the outside of the dispensing tube.

DETAILED DESCRIPTION OF THE PREFERRED EMBODIMENTS

Figure 1:
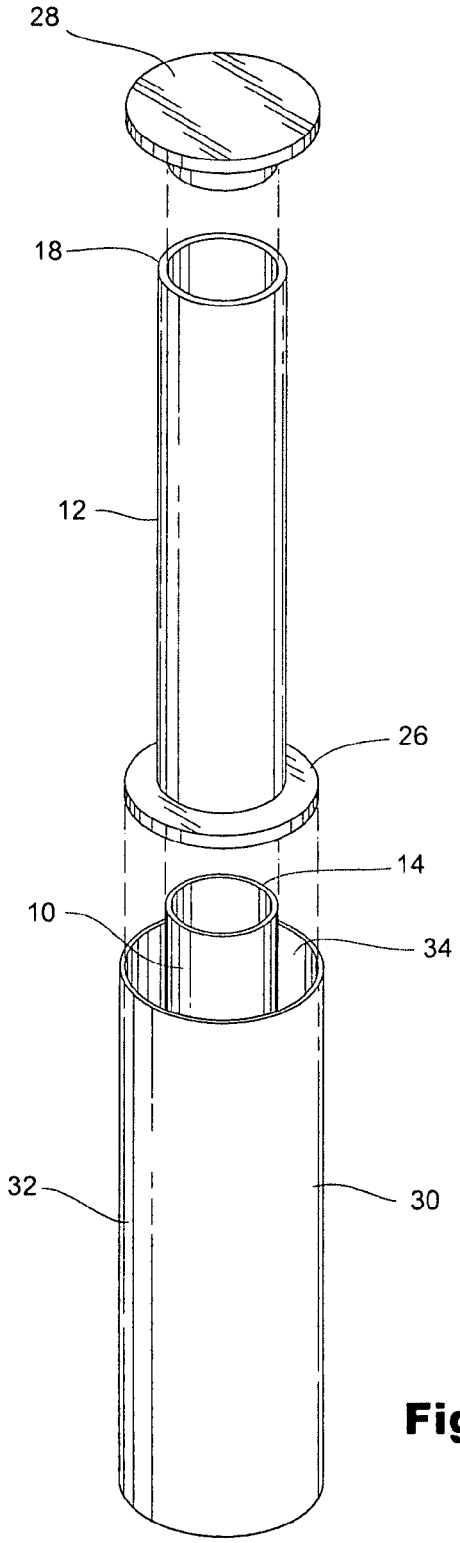
FIG. 1 is a perspective view of the light string encasing assembly of the present invention, shown with a handle concentrically about a feed tube aligned with a dispensing tube and a dispensing tube cap for assembly.
Figure 2:
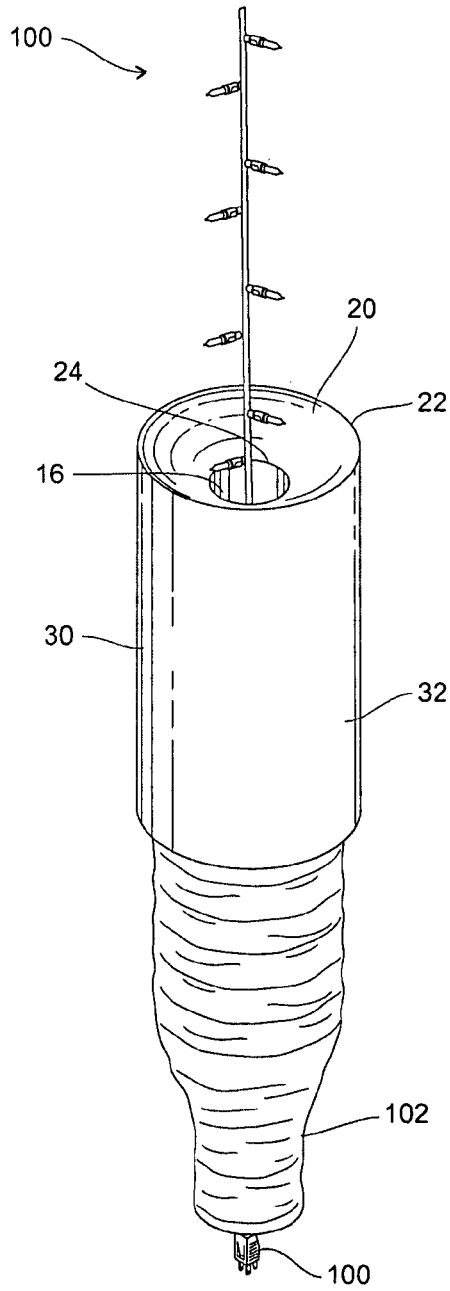
FIG. 2 is a perspective view showing a funnel at the entry end and the dispensing tube extending from within the handle and a non-rigid tubular material compressed around the dispensing tube, the material shown being withdrawn from the dispensing tube over a light string representative of an elongate material also shown entering the funnel.
Figure 3:
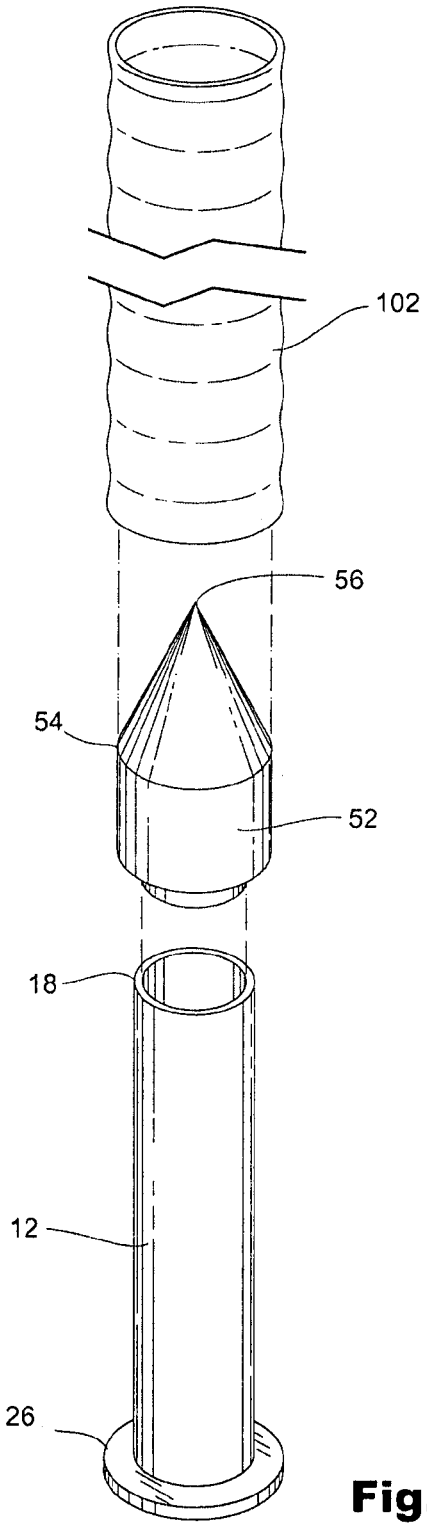
FIG. 3 is a perspective view of the dispensing tube shown aligned with a loading cone and the non-rigid tubular material aligned to load over the loading cone to the dispensing tube.
Figure 4:
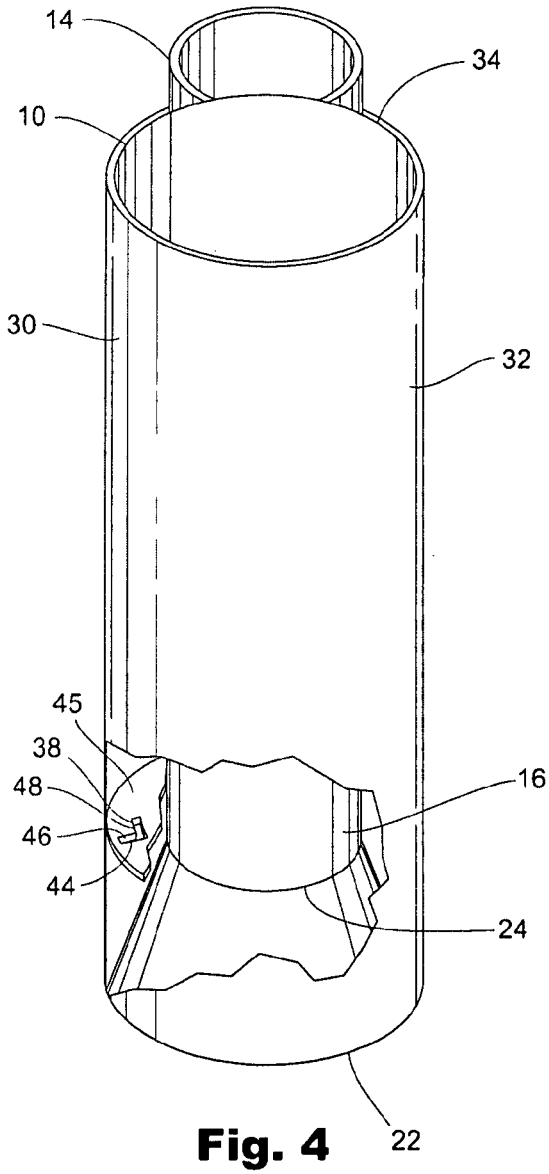
FIG. 4 is a cut-away perspective view showing the funnel and feed tube concentrically within the handle and a catch member adapted to receive a matching catch member on the dispensing tube flange.
Figure 5:
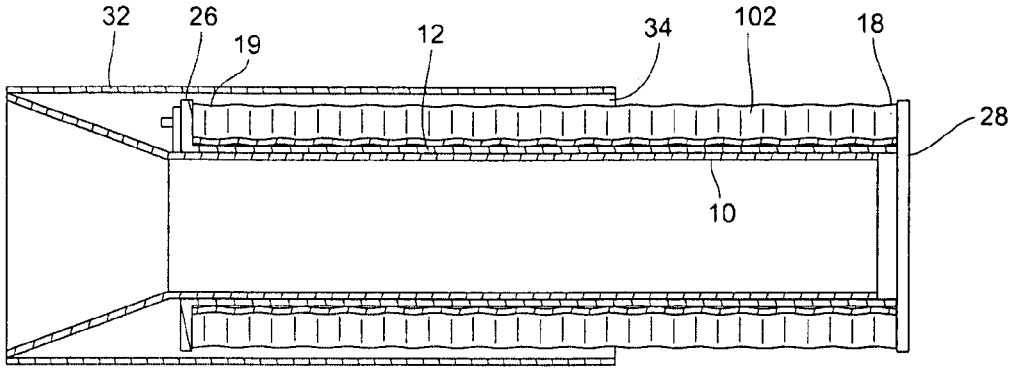
FIG. 5 is a cross-sectional view showing the funnel and feed tube concentrically within the handle, the catch, and the dispensing tube with non-rigid material compressed thereon on the feed tube and extending from the handle with a dispensing tube with a flange cap on the dispensing tube dispensing end preventing the non-rigid material from falling off the dispensing tube.
Figure 6:
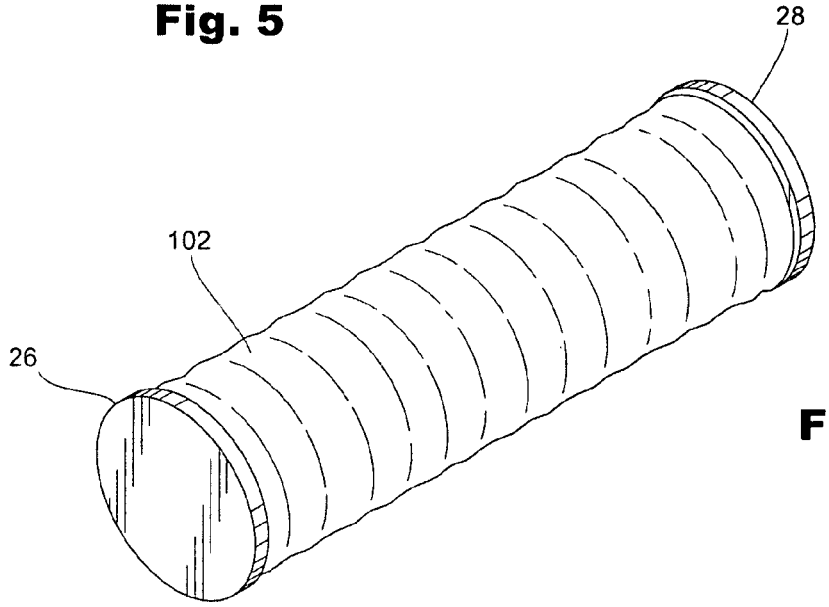
FIG. 6 is a perspective view of the dispensing tube shown loaded with a non-rigid material compressed thereon and maintained on the dispensing tube by the flange cap.
Figure 7:
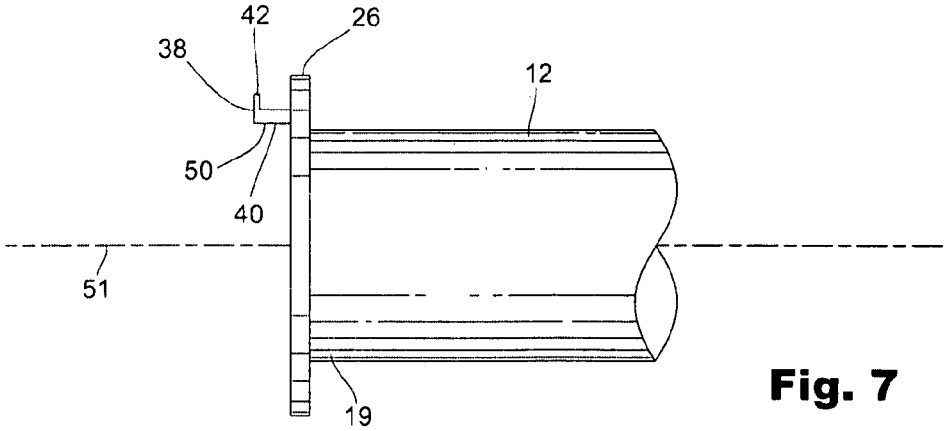
FIG. 7 is a side view of the non-dispensing end of the dispensing tube showing a hook on the dispensing tube flange representative of a second catch member matching circular and radial slots on an extension of the feed tube as a first catch member.

The assembly of the present invention for encasing an elongated article 100 for storage comprises a feed tube 10 adapted such that the elongated article 100 may pass therethrough, a dispensing tube 12 adapted to removably slide over the feed tube 10, and a replaceable non-rigid tubular material 102 longitudinally compressible over the dispensing tube 12 remote from the feed tube 10. Access to the feed tube exit end 14 is open and unrestricted therein providing quick and facile mounting of the dispensing tube 12 on and removal from the feed tube 10. With the dispensing tube 12 mounted over the feed tube 10 and the elongated article 100 entering the feed tube 10 through a feed tube entry end 16 the tubular material 102 is dispensed from a dispensing end 18 of the dispensing tube 12 over the elongated article 100 as the elongated article exits the feed tube 10 from a feed tube exit end 14. The feed tube 10 is further adapted to sequentially receive one or more of a plurality of the dispensing tubes 12 on each of which is mounted a said tubular material 102 and in which tubular material 102 on each dispensing tube 12 a different elongated article 100 may be encased. A funnel 20 is provided with its small end connected to the feed tube feed end such that said elongated material is funneled through the funnel 20 from its large end 22 to its small end 24 and into the feed tube 10.

A flange 26 extending radially from the circumference of the dispensing tube 12 adapted to retain said tubular material 102 from falling off a dispensing tube non-dispensing end 19. A flange cap 28 is also provided to removably install on the dispensing tube dispensing end 18 in retaining the tubular material 102 from falling off the dispensing tube dispensing end 18. The flange cap 28 is removable for loading and for dispensing said tubular material 102 from the dispensing tube 12.

A handle 30 comprises a canister 32 mounted concentrically with the feed tube 10 at the feed tube entry end 16 and extends longitudinally along the feed tube 10 toward the feed tube exit end 14 forming an annular slot 34 into which a dispensing tube 12 may be received such that during use the assembly may be held with one user hand without hand contact with the feed tube 10 or the dispensing tube 12 so as not to interfere with the tubular material 102 while another user hand pulls the elongated article 100 from the feed tube exit end 14 encased with the tubular material 102. Typically, the handle 30 mounts to and extends from the large end 22 of the funnel 20 over at least a portion of the feed tube 10 and over at least a portion of the dispensing tube 12 when it is mounted over the feed tube 10.

On the dispensing tube 12 is a catch 38 adapted to releasably secure the dispensing tube 12 to the feed tube 10. The catch 38 is typically on the dispensing tube flange 26 with a first catch member 40 such as a hook 42 on the flange 26 engaging a matching second catch member 44 on the feed tube 10, or an extension 45 of the feed tube. The second catch member 44 may be a radial slot 46 intersecting an intersecting circular slot 48 on the flange 26 such that the hook 42 enters the radial slot 46 and when the dispensing tube 12 is twisted on its longitudinal axis 51 the leg 50 of the hook 42 passes through the circular slot 48 and the hook 42 is then engaged with the flange 26. The hook 42 is released simply by counter-twisting the dispensing tube 12 and pulling the hook 42 back through the radial slot 46.

A loading cone 52 that tapers from a cone large end 54 to a cone small end 56 may be removably mounted with the cone large end 54 mounted to the dispensing tube dispensing end 18. Tubular material 102 is then easily loadable over the loading cone 52 and onto the dispensing tube 12 with the cone small end 56 extending from the dispensing tube dispensing end 18.

Advantageously, a plurality of dispensing tubes 12 is typically provided, each of which is adapted to removably slide over the feed tube 10, dispensing tube 12 is quickly replaceable with a different said dispensing tube 12 preloaded with said tubular material 102 so delay between encasing different elongated articles 100 is minimized to that required only to exchange dispensing tubes. In use, a dispensing tube 12 is selected from the plurality of dispensing tubes, which is then releasably mounted over the feed tube 10. After the tubular material 102 is dispensed over an elongated article 100, it is quickly removed and another selective dispensing tube 12 is mounted over the feed tube 10 without waiting to reload the empty dispensing tube 12.

Having described the invention, what is claimed is as follows:

1. An assembly for encasing an elongated article for storage, comprising a feed tube adapted such that the elongated article may pass therethrough, a dispensing tube adapted to removably slide over the feed tube, a replaceable non-rigid tubular material longitudinally compressible over the dispensing tube remote from the feed tube, wherein with the dispensing tube mounted over the feed tube and the elongated article entering the feed tube through a feed tube entry end the replaceable non-rigid tubular material is dispensed from a dispensing end of the dispensing tube over the elongated article as the elongated article exits the feed tube from a feed tube exit end, and comprising a catch on the dispensing tube flange adapted to releasably secure the dispensing tube to the feed tube.

2. The assembly of claim 1 wherein the catch comprises a first catch member on the flange and a matching second catch on the feed tube releasable engaging the flange.

3. The assembly of claim 1 including a flanged cap adapted to removably install on the dispensing tube dispensing end and further adapted to retain said replaceable non-rigid tubular material from falling off the dispensing tube dispensing end, which flanged cap is removable for loading and for dispensing said replaceable non-rigid tubular material from the dispensing tube.

4. The assembly of claim 1 further comprising a loading cone tapering from a cone large end to a small end, the large end adapted to removably mount to the dispensing tube dispensing end, the loading cone adapted to facilitate easy loading of the replaceable non-rigid tubular material onto the dispensing tube.

5. The assembly of claim 1 further comprising a canister mounted concentrically with the feed tube at the feed tube entry end and extending longitudinally along the feed tube toward the feed tube exit end forming a circular slot into which a dispensing tube is received.

6. The assembly of claim 1 wherein the canister is a handle such that during use the device is held without interference with the replaceable non-rigid tubular material while the elongated article is pulled from the feed tube exit end encased with the replaceable non-rigid tubular material.

7. The assembly of claim 1 further comprising a funnel with its small end connected to the feed tube feed end such that said elongated material is funneled through the funnel from its large end to its small end and into the feed tube.

8. An assembly for encasing an elongated article for storage, comprising a feed tube adapted such that the elongated article may pass therethrough, a dispensing tube adapted to removably slide over the feed tube, wherein access to the feed tube exit end is open and unrestricted therein providing quick and facile mounting of said dispensing tube on and removal from said feed tube a replaceable non-rigid tubular material longitudinally compressible over the dispensing tube remote from the feed tube, wherein with the dispensing tube mounted over the feed tube and the elongated article entering the feed tube through a feed tube entry end the replaceable non-rigid tubular material is dispensed from a dispensing end of the dispensing tube over the elongated article as the elongated article exits the feed tube from said feed tube exit end, a handle comprising a canister mounted concentrically with the feed tube at the feed tube entry end and extending longitudinally along the feed tube toward the feed tube exit end forming an annular slot into which a dispensing tube is received, such that during use the assembly is held without hand contact with the feed tube or the dispensing tube so as not to interfere with the replaceable non-rigid tubular material while the elongated article is pulled from the feed tube exit end encased with the replaceable non-rigid tubular material.

9. The assembly of claim 8 further comprising a funnel with its small end connected to the feed tube entry end such that said elongated material disposed to enter the feed tube is funneled through the funnel from a funnel large end to a funnel small end and into the feed tube and wherein the handle is secured to the funnel large end.

10. The assembly of claim 8 further comprising a flange extending radially from the circumference of the dispensing tube adapted to retain said replaceable non-rigid tubular material from falling off a dispensing tube non-dispensing end, and a flanged cap adapted to removably install on the dispensing tube dispensing end adapted to retain said replaceable non-rigid tubular material from falling off the dispensing tube dispensing end.

11. An assembly for encasing an elongated article for storage, comprising a feed tube adapted such that the elongated article passes therethrough, a plurality of dispensing tubes, each of which is adapted to removably slide over the feed tube, a replaceable non-rigid tubular material longitudinally compressible over the dispensing tube remote from the feed tube, wherein with a said dispensing tube mounted over the feed tube and the elongated article entering the feed tube through a feed tube entry end the replaceable non-rigid tubular material is dispensed from a dispensing end of the dispensing tube over the elongated article as the elongated article exits the feed tube from a feed tube exit end, and wherein the feed tube is adapted to receive a selective dispensing tube from said plurality of dispensing tubes on which is mounted said replaceable non-rigid tubular material, a handle comprising a canister mounted concentrically with the feed tube at the feed tube entry end and extending longitudinally along the feed tube toward the feed tube exit end forming an annular slot into which a dispensing tube is received, such that during use the assembly is held without hand contact with the feed tube or the dispensing tube so as not to interfere with the replaceable non-rigid tubular material while the elongated article is pulled from the feed tube exit end encased with the replaceable non-rigid tubular material.

12. The assembly of claim 11 further comprising a flange extending radially from the circumference of the dispensing tube adapted to retain said replaceable non-rigid tubular material from falling off a dispensing tube non-dispensing end, and a flanged cap adapted to removably install on the dispensing tube dispensing end adapted to retain said replaceable non-rigid tubular material from falling off the dispensing tube dispensing end.

13. The assembly of claim 11 wherein the catch comprises a first catch member on the dispensing tube and a second catch on the feed tube releasable engaging the first member in releasably securing the dispensing tube to the feed tube.

14. The assembly of claim 11 further comprising a loading cone tapering from a cone large end to a small end, the large end adapted to removably mount to the dispensing tube dispensing end, the loading cone adapted to facilitate easy loading of the replaceable non-rigid tubular material onto the dispensing tube.

15. The assembly of claim 11 further comprising a funnel with its small end connected to the feed tube feed end such that said elongated material is funneled through the funnel from its large end to its small end and into the feed tube.

* * * * *